United States Patent [19]

Toya et al.

[11] Patent Number: 4,728,450

[45] Date of Patent: Mar. 1, 1988

[54] TORQUE GREASE

[75] Inventors: Masanori Toya; Hiroshi Kimura, both of Ohta, Japan

[73] Assignee: Toshiba Silicone Co., Ltd., Japan

[21] Appl. No.: 622,932

[22] Filed: Jun. 21, 1984

[30] Foreign Application Priority Data

Jul. 13, 1983 [JP] Japan ..... 58-127088

[51] Int. Cl.[4] ..... C10M 175/00

[52] U.S. Cl. ..... 252/49.6

[58] Field of Search ..... 252/49.6

[56] References Cited

U.S. PATENT DOCUMENTS

| | | | |
|---|---|---|---|
| 2,599,984 | 6/1952 | Fletcher | 252/49.6 |
| 2,614,989 | 10/1952 | Hunter et al. | 252/49.6 |
| 3,145,175 | 8/1964 | Wright | 252/49.6 |
| 3,288,712 | 11/1966 | Stark | 252/49.6 |
| 3,291,735 | 12/1966 | Brown | 252/49.6 |
| 3,304,259 | 2/1967 | Wright | 252/49.6 |
| 3,334,120 | 8/1967 | Holbrook et al. | 252/49.6 |
| 3,518,188 | 6/1970 | Pirson et al. | 252/49.6 |
| 3,542,732 | 11/1970 | Austin et al. | 252/49.6 |
| 3,671,429 | 6/1972 | Wright | 252/49.6 |

*Primary Examiner*—William R. Dixon, Jr.
*Assistant Examiner*—Cynthia A. Prezlock
*Attorney, Agent, or Firm*—John W. Harbour

[57] ABSTRACT

A torque grease comprising:

(A) 100 parts by weight of a polyorganosiloxane represented by the general formula:

$$\left(R_a{}^1SiO_{\frac{4-a}{2}}\right)_n$$

wherein $R^1$ is a $C_{(1-12)}$ monovalent radical selected from the group consisting of alkyl radicals, alkenyl radicals, and substituted or unsubstituted aryl radicals; a equals 1.9 to 2.7; n is a positive number; and (B) 10 to 200 parts by weight of a polyorganosilsesquioxane represented by the general formula:

$$R^2SiO_{3/2}$$

wherein $R^2$ is a monovalent radical selected from the group consisting of alkyl radicals, alkenyl radicals and substituted or unsubstituted aryl radicals.

8 Claims, 1 Drawing Figure

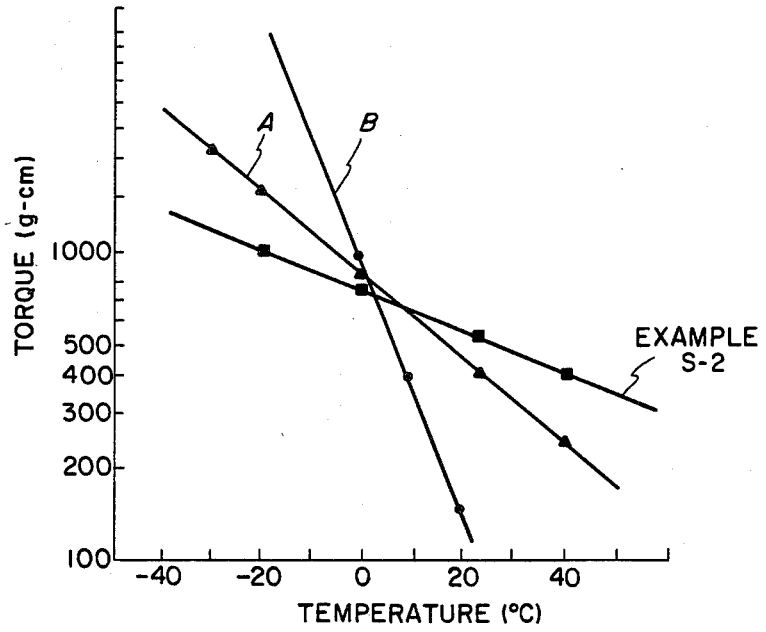
TORQUE (g-cm)
1000
500
400
300
200
100
-40
-20
0
20
40
TEMPERATURE (°C)
A
B
EXAMPLE
S-2

TORQUE GREASE

The present application claims priority of Japanese patent application Ser. No. 83/127088, filed July 13, 1983.

BACKGROUND OF THE INVENTION

The present invention relates to a torque grease which is used to give lubricity for the rotation of a rotary shaft of, for example, a rotary variable resistor or a dial in an electronic component or an audio device, and to impart a feeling of a high-grade article owing to the rotary torque of a bearing to a person who rotates the shaft.

It is well known in the art that greases, such as a mixture of polyisobutene and a thickener or a mixture of polyisobutene, a mineral oil and a thickener, are useful to give lubricity for a rotating shaft of a rotary volume dial in an electronic component, an audio device, or the like, and to produce a rotating shaft having the feel of high-grade article.

However, these greases have disadvantages in that the viscosity of the polyisobutene may suddenly decrease resulting in bleeding of the grease from the coated area, or the polyisobutene can decompose to cause hardening of the grease. Also, when the grease is allowed to stand in the atmosphere above 100° C. for a long time, or the grease is allowed to solidify in the atmosphere near 0° C., rotation of the resistor dial becomes difficult or even impossible.

Some attempts have been made to overcome the disadvantages described above. For example, silicone greases having moderate tackiness as described in Japanese Patent Laid-Open No. 66552/1975 and No. 43171/1978. More particularly, Japanese Patent Laid-Open No. 66552/1975 discloses a silicone grease comprising a polydiorganosiloxane, consisting of $R_3SiO_{1/2}$ units, $R_2SiO$ units and $SiO_2$ units, and a thickener; Japanese Patent Laid-Open No. 43171/1978 discloses a silicone grease comprising a polydiorganosiloxane, a polyorganosiloxane composition consisting of $R_3SiO_{1/2}$ units, $RSiO_{3/2}$ units and $SiO_2$ units, and a thickener, wherein R is a group selected from alkyl radicals, alkenyl radicals and aryl radicals.

These silicone greases have improved operating characteristics at low-temperatures as compared with the polybutene greases, but the operating characteristics are not sufficient as yet. Furthermore, the silicone greases have disadvantages in that the torque is decreased and finally the rotating shaft is abraded to become inoperable (or "seize up") when the rotary resistor dial is operated for a long time.

Now it has been found that the lowering of the operating characteristcs and the torque at low-temperatures as described above is caused by the polyorganosiloxanes consisting of $R_3SiO_{1/2}$, $RSiO_{3/2}$, $R_2SiO$ and $SiO_2$ units used as a base fluid in conventional silicone greases.

That is to say, the polyorganosiloxane consisting of $R_3SiO_{1/2}$, $RSiO_{3/2}$, $R_2SiO$ and $SiO_2$ units is used to enhance the tackiness of silicone greases, but at low temperatures it tends to crystallize, so that rotary operation becomes difficult and the rotating shaft is abraded upon operating it for a long time to result in seizing up.

SUMMARY OF THE INVENTION

The present invention aims at overcoming these disadvantages and its object is to provide a torque grease which exhibits excellent tackiness over a wide temperature range and has a reduced change in torque after extended use and has a prolonged operating life by incorporating polyorganosilsesquioxane with the silicone base fluid.

The present invention provides a torque grease comprising (A) 100 parts of a polyorganosiloxane represented by the general formula:

$$(R_a^1SiO_{(4-a)/2})_n$$

wherein $R^1$ is a monovalent radical having 1 to 12 carbon atoms selected from the group consisting of alkyl radicals, alkenyl radicals, and substituted or unsubstituted aryl radicals; a is 1.9 to 2.7; n is a positive number, and (B) 10 to 200 parts of a polyorganosilsesquioxane represented by the general formula:

$$R^2SiO_{3/2}$$

wherein $R^2$ is a monovalent radical selected from the group consisting of alkyl radicals, alkenyl radicals, and substituted or unsubstituted aryl radicals.

THE DRAWING

The Drawing shows changes in torques of grease S-2, commercially available silicone grease A, and polybutene grease B versus temperature.

DESCRIPTION OF THE INVENTION

In accordance with the present invention there is provided a torque grease comprising:

(A) 100 parts of a polyorganosiloxane represented by the general formula:

$$(R_a^1SiO_{(4-a)/2})_n$$

wherein $R^1$ is a monovalent radical having 1 to 12 carbon atoms selected from the group consisting of alkyl radicals, alkenyl radicals, and substituted or unsubstituted aryl radicals; a is 1.9 to 2.7; n is a positive number, and (B) 10 to 200 parts of a polyorganosilsesquioxane represented by the general formula:

$$R^2SiO_{3/2}$$

wherein $R^2$ is a monovalent radical selected from the group consisting of alkyl radicals, alkenyl radicals, and substituted or unsubstituted aryl radicals.

The components of the torque grease according to the invention and their amounts are defined as above for the following reasons.

That is to say, the polyorganosiloxane (A) is the principal ingredient of the torque grease according to the present invention and is represented by the general formula:

$$(R_a^1SiO_{(4-a)/2})_n$$

where $R^1$ is a $C_{1-12}$ monovalent radical selected from the group consisting of alkyl radicals, alkenyl radicals and substituted or unsubstituted aryl radicals. If the number of carbon atoms exceeds 12, the polyorganosiloxane will be difficult to handle and its thermal stability will decrease. The $R^1$ radicals may be the same or different from each other. Examples of $R^1$ include alkyl groups such as methyl, ethyl, propyl, butyl, pentyl, hexyl, octyl, decyl and dodecyl; alkenyl groups such as vinyl and allyl; and aryl groups such as phenyl and chlorinated phenyl. The methyl group is preferred because of the ease of its preparation and its thermal stability.

When the a in the general formula of component (A) is less than 1.9, the resulting grease will be too hard to use, while when it is more than 2.7, the resulting grease will not exhibit a suitable viscosity. The n in the general formula of component (A) is preferably the number which affords a polyorganosiloxane having a viscosity in the range described below.

It is preferred that polyorganosiloxane (A) has a viscosity of 50 to 500,000 cSt at 25° C. If the viscosity of the polyorganosiloxane is less than 50 cSt, it will have a larger volatility and the resulting grease will easily flow. On the other hand, a polyorganosiloxane having a viscosity higher than 500,000 cSt is not preferred because its preparation and its handling are difficult.

In the polyorganosilsesquioxane (B) represented by the general formula:

$$R^2SiO_{3/2}$$

$R^2$ may be the same as $R^1$ in the formula of component (A) or different from it. Examples of $R^2$ include alkyl groups such as methyl, ethyl and propyl, alkenyl groups such as vinyl, and aryl groups such as phenyl. The polyorganosilsesquioxane (B) can be obtained as a powder by hydrolytic condensation of the corresponding silanes or their mixtures according to conventional processes.

The polyorganosilsesquioxane (B) is used to impart moderate tackiness and consistency to polyorganosiloxane (A). The amount of component (B) is 10 to 200 parts per 100 parts of component (A).

If the amount is less than 10 parts, the resulting grease will not exhibit appropriate tackiness and consistency. Furthermore, the resulting grease will tend to flow readily to result in poor torque, bleeding and separation, when applied to a rotating shaft of a rotary resistor dial. If the amount exceeds 200 parts, the resulting grease will be too hard to be applied to a rotating shaft. Furthermore, the resulting grease will be unable to give suitable torque and necessary lubricity, so that the rotating shaft will be exceedingly abraded and result in seizing.

Because the polyorganosilsesquioxane alone cannot impart sufficient thickening to the composition, if necessary, a thickener such as fine silica powders, carbon, graphites, molybdenum disulfide or polytetrafluoroethylene resins may be added to prevent the greases from bleeding from the rotating shafts.

The torque greases according to the present invention can be readily prepared by mixing all the components described above by conventional means, or by mixing them under heating at a given temperature followed by cooling and uniformly kneading by a triple roll mill such as a paint roll.

EXAMPLES

Examples according to the present invention will now be described. In these examples, parts are given in parts by weight.

Polyorganosilsesquioxanes were prepared according to the following Referential Examples.

Referential Example 1

100 parts of methyltrimethoxysilane were hydrolyzed and condensed in 400 parts of 5% aqueous ammonia to obtain a polymethylsilsesquioxane. The polymethylsilsesquioxane was dried and further ground to obtain powder P-1 having a particle size of below 250 mesh.

Referential Example 2

134 parts of methyltrichlorosilane and 21 parts of phenyltrichlorosilane were co-hydrolyzed and condensed. The resulting product was dried and ground as described in Referential Example 1 to obtain polymethylsilsesquioxane powder P-2 having a particle size of below 250 mesh.

Example 1

100 parts of polydimethylsiloxane having a viscosity of 300,000 cSt (measured at 25° C.; the same condition applies hereinafter) and 50 parts of P-1 prepared in Referential Example 1 were mixed under stirring while heating at 150° C. and thereafter cooled and uniformly kneaded by a paint roll to obtain grease S-1 having a penetration of 329.

Example 2

100 parts of polydimethylsiloxane having a viscosity of 100,000 cSt and 50 parts of P-1 were mixed and kneaded as described in Example 1 to obtain grease S-2 having a penetration of 369.

Example 3

100 parts of polydimethylsiloxane having a viscosity of 50,000 cSt and 75 parts of P-1 were mixed and kneaded as described in Example 1 to obtain grease S-3 having a penetration of 278.

Example 4

100 parts of polydimethylsiloxane having a viscosity of 10,000 cSt and 100 parts of P-1 were mixed and kneaded as described in Example 1 to obtain grease S-4 having a penetration of 324.

Example 5

100 parts of polydimethylsiloxane having a viscosity of 10,000 cSt, 50 parts of P-1 and 3 parts of surface-treated fine silica powder were mixed and kneaded as described in Example 1 to obtain grease S-5 having a penetration of 350.

Example 6

33 parts of polydimethylsiloxane having a viscosity of 10,000 cSt, 66 parts of polydimethylsiloxane having a viscosity of 1,000 cSt and 100 parts of P-1 were mixed and kneaded as described in Example 1 to obtain grease S-6 having a penetration of 298.

Example 7

100 parts of polydimethylsiloxane having a viscosity of 50,000 cSt and 70 parts of P-2 prepared in Referential Example 2 were mixed and kneaded as described in Example 1 to obtain grease S-7 having a penetration of 283.

Example 8

100 parts of polydimethylsiloxane having a viscosity of 10,000 cSt, 50 parts of P-2 and 3 parts of surface-treated fine silica powder were mixed and kneaded as described in Example 1 to obtain grease S-8 having a penetration of 324.

Example 9

100 parts of trimethylsiloxy terminated polymethylphenylsiloxane having a viscosity of 10,000 cSt and consisting of 5 molar % diphenylsiloxy units and the balance dimethylsiloxy units, and 70 parts of P-2 were homogeneously mixed to obtain grease S-9 having a penetration of 315.

Example 10

100 parts of trimethylsiloxy terminated polymethylhexylsiloxane having a viscosity of 5,000 cSt and consisting of 5 mole % methylhexylsiloxy units and the remainder dimethylsiloxy units, and 75 parts of P-1 were homogeneously mixed to obtain grease S-10 having a penetration of 320.

Example 11

30 parts of trimethylsiloxy terminated polymethyl (tetrachlorophenyl) siloxane having a viscosity of 100 cSt and consisting of 8 molar % tetrachlorophenylsiloxy units and the balance dimethylsiloxy units, and 70 parts of polydimethylsiloxane having a viscosity of 50,000 cSt were mixed to obtain a silicone oil. 100 parts of silicone fluid, 50 parts of P-2 and 5 parts of fine silica powder were homogeneously mixed to obtain grease S-11 having a penetration of 315.

Comparative Example 1

50 parts of polydimethylsiloxane having a viscosity of 100,000 cSt, 50 parts of organosiloxane consisting of $(CH_3)_3SiO_{1/2}$ units and $SiO_2$ units (in a ratio of 0.8), 5 parts of surface-treated fine silica powder and 8 parts of Teflon powder were mixed and kneaded as described in Example 1 to obtain grease R-1 having a penetration of 300.

Comparative Example 2

100 parts of polydimethylsiloxane having a viscosity of 10,000 cSt and 50 parts of surface-treated fine silica powder were mixed and kneaded as described in Example 1 to obtain grease R-2 having a penetration of 90.

Comparative Example 3

100 parts of polydimethylsiloxane having a viscosity of 10,000 cSt and 50 parts of polytetrafluoroethylene powder were mixed and kneaded as described in Example 1 to obtain grease R-3 having a penetration of 226.

The characteristics of the resulting greases were determined according to the following experiments:

Each of S-1 to S-11 and R-1 to R-3 greases was applied to a shaft made of steel of 6.15 mm diameter and 20.5 mm length placed on a bearing made of brass of 6.20 mm diameter and 25.0 mm length. The shaft was rotated at a torque rotation rate of 20 rpm.

The torque after 60 seconds (initial), 10 minutes, 20 minutes and 30 minutes and at −30° C. are shown in the following Table.

TABLE

| Characteristics | | S-1 | S-2 | S-3 | S-4 | S-5 | S-6 | S-7 | S-8 | S-9 | S-10 | S-11 | R-1 | R-2 | R-3 |
|---|---|---|---|---|---|---|---|---|---|---|---|---|---|---|---|
| Torque (g · cm) | after 60 sec | 600 | 530 | 400 | 320 | 250 | 370 | 450 | 240 | 280 | 350 | 220 | 550 | 590 | 140 |
| | after 10 min | 550 | 460 | 400 | 275 | 250 | 330 | 440 | 240 | 270 | 330 | 220 | 340 | 250 | 130 |
| | after 20 min | 500 | 450 | 400 | 260 | 220 | 300 | 430 | 230 | 260 | 320 | 210 | 210 | 230 | 125 |
| | after 30 min | 400 | 430 | 390 | 250 | 210 | 290 | 430 | 230 | 260 | 310 | 200 | 180 | 170 | 100 |
| | at low temperature (−30° C.) | 1600 | 1400 | 1100 | 900 | 650 | 1000 | 1200 | 600 | 650 | 1000 | 550 | 4500 | 1600 | 400 |

EFFECT OF THE INVENTION

The torque greases according to the present invention undergo less changes in consistency and torque over the wide temperature range and have a long operating life. The torque greases are useful for rotary resistor dials in electrical appliances such as audio devices, radios, or televisions and other acoustic communication equipment.

I claim:

1. A torque grease comprising:

(A) 100 parts by weight of a polyorganosiloxane represented by the general formula:

$$\left(R_a^1SiO_{\frac{4-a}{2}}\right)_n$$

wherein $R^1$ is a $C_{(1-12)}$ monovalent radical selected from the group consisting of alkyl radicals, alkenyl radicals, and substituted or unsubstituted aryl radicals; a equals 1.9 to 2.7; n is a positive number; and (B) 10 to 200 parts by weight of a polyorganosilsesquioxane represented by the general formula:

$$R^2SiO_{3/2}$$

wherein $R^2$ is a monovalent selected from the group consisting of alkyl radicals, alkenyl radicals and substituted or unsubstituted aryl radicals.

2. A torque grease according to claim 1 wherein $R^1$ of polyorganosiloxane (A) is a methyl group.

3. A torque grease according to claim 1 wherein polyorganosiloxane (A) has a viscosity of 50 to 500,000 cSt at 25° C.

4. A torque grease according to claim 2 wherein polyorganosiloxane (A) has a viscosity of 50 to 500,000 cSt at 25° C.

5. A torque grease according to claim 1 wherein the polyorganosilsesquioxane (B) is polymethylsilsesquioxane.

6. A torque grease according to claim 2 wherein the polyorganosilsesquioxane (B) is polymethylsilsesquioxane.

7. A torque grease according to claim 3 wherein the polyorganosilsesquioxane (B) is polymethylsilsesquioxane.

8. A torque grease according to claim 4 wherein the polyorganosilsesquioxane (B) is polymethylsilsesquioxane.

* * * * *